US008523694B2

(12) United States Patent
Hartwig

(10) Patent No.: US 8,523,694 B2
(45) Date of Patent: Sep. 3, 2013

(54) PLAYING SURFACE FOR A GAMING TABLE AND METHOD OF PRODUCING SAME

(75) Inventor: Matthew Hartwig, Lansdale, PA (US)

(73) Assignee: DMI Sports, Inc., Ft. Washington, PA (US)

( * ) Notice: Subject to any disclaimer, the term of this patent is extended or adjusted under 35 U.S.C. 154(b) by 216 days.

(21) Appl. No.: 12/981,786

(22) Filed: Dec. 30, 2010

(65) Prior Publication Data

US 2011/0159974 A1 Jun. 30, 2011

Related U.S. Application Data

(60) Provisional application No. 61/291,465, filed on Dec. 31, 2009.

(51) Int. Cl.
*A63D 15/00* (2006.01)

(52) U.S. Cl.
USPC ..... 473/29; 473/1

(58) Field of Classification Search
USPC ..... 473/28, 29, 31, 32, 4; 273/108.21
See application file for complete search history.

(56) References Cited

U.S. PATENT DOCUMENTS

| | | | | |
|---|---|---|---|---|
| 1,524,758 | A * | 2/1925 | Stedman et al. | 473/28 |
| 1,566,057 | A * | 12/1925 | Wilkinson | 273/108.21 |
| 1,881,387 | A * | 10/1932 | Johnson | 473/3 |
| 1,933,917 | A * | 11/1933 | Matteson | 473/34 |
| 1,946,232 | A * | 2/1934 | Olsen et al. | 473/3 |
| 3,902,719 | A * | 9/1975 | Frierman | 473/41 |
| 4,579,342 | A * | 4/1986 | Mortensen | 473/3 |
| 6,244,969 | B1 * | 6/2001 | Murphy et al. | 473/29 |
| 2011/0159974 | A1 * | 6/2011 | Hartwig | 473/29 |

FOREIGN PATENT DOCUMENTS

| | | | |
|---|---|---|---|
| CN | 201164712 | Y * | 12/2008 |
| DE | 2362804 | A * | 6/1974 |
| EP | 696559 | A1 * | 2/1996 |
| FR | 2594703 | A1 * | 8/1987 |
| GB | 2124971 | A * | 2/1984 |
| WO | WO 8202002 | A * | 6/1982 |

* cited by examiner

*Primary Examiner* — Mitra Aryanpour
(74) *Attorney, Agent, or Firm* — Panitch Schwarze Belisario & Nadel LLP

(57) ABSTRACT

A playing surface for a gaming table includes a composite sheet including concrete and at least one fiber component. The composite sheet has a density of approximately one to two grams per cubic centimeter (1-2 g/cm$^3$).

3 Claims, 3 Drawing Sheets

PLAYING SURFACE FOR A GAMING TABLE AND METHOD OF PRODUCING SAME

CROSS-REFERENCE TO RELATED APPLICATIONS

The present application claims priority to U.S. Provisional Patent Application No. 61/291,465, filed Dec. 31, 2009 and entitled "Playing Surface for a Gaming Table and Method of Producing Same."

BACKGROUND OF THE INVENTION

The present invention is directed to a playing surface for a gaming table and a method of producing the same and, more particularly, to a man-made composite material for billiard and/or snooker tables that is cheaper and easier to manufacture as compared to slate table-tops and is more dense than wood table-tops.

The sport or game of billiards and snooker are well-known. One of the essential elements to the enjoyment and competitive nature of playing these sports is the consistent smoothness and flatness of the playing surface, along with the substantial density of the playing surface. A typical table is relatively large, as the playing surface of such tables often measures eight feet in length and four feet in width. In order to ensure that the playing surface is substantially flat over this relatively large area, the playing surface is typically constructed using dense materials, such as slate. The slate is then covered with a cloth material, such as felt, to form the playing surface. While slate playing surfaces are commonly used and sometimes preferred for billiard and/or snooker tables, alternative materials, such as wood, have become more commonplace.

Existing playing surface materials have a number of characteristics and/or attributes that could be improved upon. For example, slate is a natural rock that is only available in certain parts of the world and must be mined and transported at substantial costs, at least in part due to the relative great weight of slate. Due to slate's relative density and rigidity, sophisticated cutting tools are often required to cut and/or form the slate into the desired shape and/or thickness. Typically, a slate playing surface must be cut or divided into three substantially equal pieces or segments prior to installation in/on a billiard and/or snooker table to at least reduce the burden on the installers. In addition, mining slate causes undesirable environmental damage and the relatively high density (and thus weight) and brittle nature of slate makes it difficult to install and/or mount on/in a billiard or snooker table. Finally, slate is relatively difficult to cut into thin sections, causing most slate playing surfaces to be at least three-fourths (¾) of an inch thick, which generally increases the overall weight of the billiard or snooker table and makes moving and/or transporting the table difficult.

Wood playing surfaces, which are also covered with a cloth material, generally are not as dense and, therefore, not as heavy as slate playing surfaces. However, the less dense wood playing surfaces often do not provide for optimal ball rolling, as the wood playing surfaces tend to dent or become compressed at certain points upon impact from a ball creating "divots." In addition, it can be difficult to find and/or create a wood playing surface that has the relative smoothness and flatness for proper billiard and/or snooker playing. Further, wood playing surfaces are likely to degrade or warp over time due to moisture accumulation in the wood.

In light of the above-identified limitations and drawbacks of existing playing surfaces or gaming tables, the need for an alternative playing surface is apparent. Specifically, it would be desirable to produce a playing surface for a gaming table having a density sufficient to create a slate-like playing surface, yet is lighter and more flexible than slate so as to be less susceptible to breakage and/or cracks. Further, it would be desirable to produce a playing surface that can be manufactured and installed in one single piece, is less susceptible to undesirable deformation or warping than conventional wood playing surfaces, and is easier and cheaper to manufacture and/or transport than slate playing surfaces.

BRIEF SUMMARY OF THE INVENTION

Briefly stated, a preferred embodiment of the present invention is directed to a playing surface for a gaming table including a composite sheet including concrete and at least one fiber component. The composite sheet has a density of approximately one to two grams per cubic centimeter (1-2 g/cm$^3$).

In another aspect, a preferred embodiment of the present invention is directed to a billiard table including a playing surface including a composite sheet including concrete and at least one fiber component. The composite sheet having a density of approximately one to two grams per cubic centimeter (1-2 g/cm$^3$). A cloth material covers at least a portion of a top surface of the composite sheet. A body supports the playing surface in an assembled configuration. At least one leg depends downwardly from the body. At least one pocket is sized and shaped to receive a gaming ball maneuvered on the playing surface. At least one rail is positioned above the playing surface. The at least one rail extends over at least a portion of the playing surface.

In yet another aspect, a preferred embodiment of the present invention is directed to a method of producing a playing surface for a gaming table. The method includes providing a mixture of a composite sheet in a semi-solid state, depositing the semi-solid composite material onto a rotating drum, cutting the semi-solid composite material after at least two layers have formed around at least a portion of the rotating drum, laying the at least two layers of the semi-solid composite material on to a conveyor, and compressing the at least two layers of the semi-solid composite material at a predetermined pressure for a predetermined amount of time until the at least two layers of the semi-solid composite material are transformed into a solid composite sheet.

In yet another aspect, a preferred embodiment of the present invention is directed to a method of installing a playing surface in or on a gaming table. The method includes providing a single unitary piece of composite sheet having approximately the same size and shape as a top surface of the gaming table, the composite sheet including concrete and at least one fiber component, the composite sheet having a density of approximately one to two grams per cubic centimeter (1-2 g/cm$^3$). The method also includes placing the single unitary piece of composite sheet in or on the top surface of the gaming table, fastening the single unitary piece of composite sheet to the gaming table, and fastening a cloth material to at least a portion of a top surface of the single unitary piece of composite sheet.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
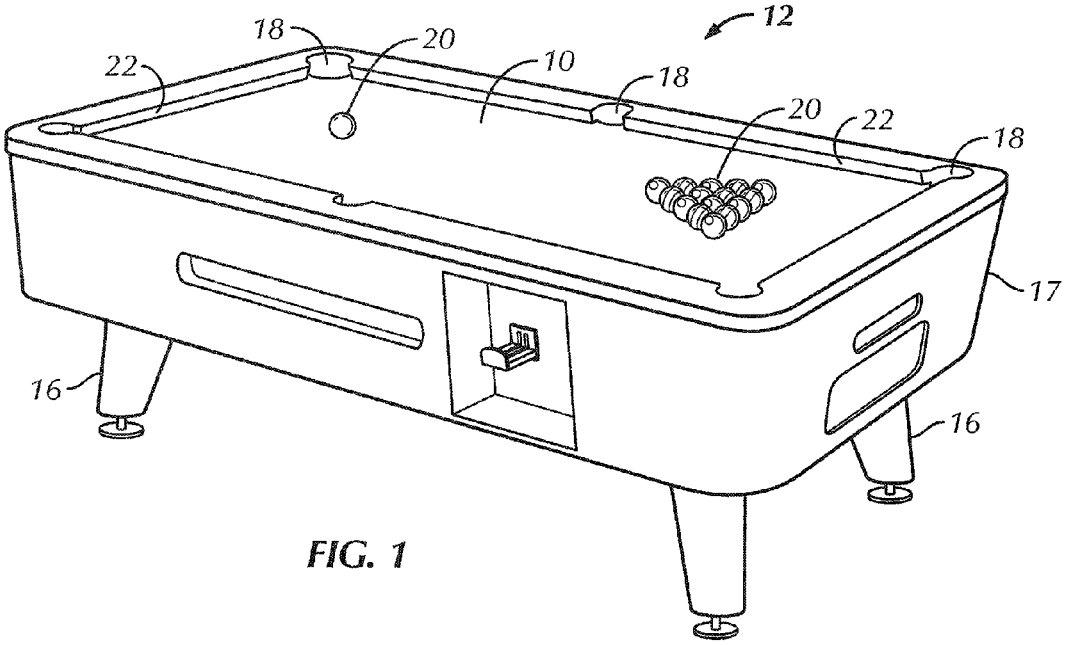
FIG. 1 is a top perspective view of a gaming table in accordance with a first preferred embodiment of the present invention.

Certain terminology is used in the following description for convenience only and is not limiting. The words "upper," "top" and "proximate" designate directions in the drawings to which reference is made. Unless specifically set forth herein, the terms "a," "an" and "the" are not limited to one element, but instead should be read as meaning "at least one." The terminology includes the above-listed words, derivatives thereof and words of similar import.

Referring to the drawings in detail, wherein like numerals indicate like elements throughout, FIGS. 1-4 show a composite sheet, generally designated 14, and a method of producing the same in accordance with the preferred embodiment of the present invention for a playing surface 10 of a gaming table 12, 12'. The composite sheet 14 is preferably formed of a least one man-made material and, preferably, is formed of a combination of man-made and natural materials. The finalized, solid composite sheet 14 is ideally designed for use as a playing surface 10 in a variety of gaming or billiard tables 12, 12', but may be used for other applications, such as a support surface. The finalized, solid composite sheet 14 is preferably manufactured to have a sufficient density to provide optimal rolling for a variety of types and/or sizes of gaming balls 20, such as a cue ball. Further, the composite sheet 14 is capable of being manufactured, compressed and/or sanded into a sufficiently flat and smooth surface to provide optimal roll for a gaming ball 20.

Figure 1A:
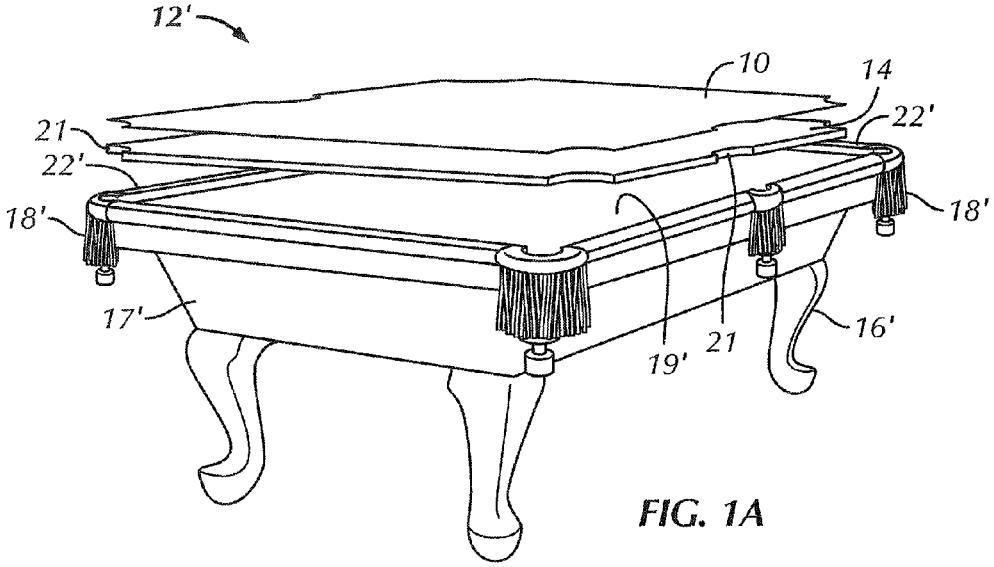
FIG. 1A is a top perspective view of a partially exploded gaming table in accordance with a second preferred embodiment of the present invention.

Referring to FIGS. 1 and 1A, the gaming table 12, 12' used in conjunction with the preferably rectangular composite sheet 14 of the present invention preferably includes at least one leg 16, 16' depending downwardly from a body 17, 17' supporting the preferably horizontally-extending playing surface 10 in an assembled configuration (FIG. 1, for example). The gaming table 12, 12' may include at least one but preferably six spaced-apart pockets 18, 18' for receiving one or more gaming balls 20. One or more rails 22, 22' preferably extend generally perpendicularly from an upper portion of the gaming table 12, 12' over at least a portion of the playing surface 10. As shown in FIG. 1A, a top surface of the gaming table 12', as surrounded by the rails 22', preferably includes a generally flat or planar surface 19', such as a wood surface, that directly engages and/or is fastened directly to a bottom surface of the composite sheet 14 following proper installation and/or assembly thereof.

Although reference herein is made specifically to a gaming table 12, 12' in the form of a billiard (pool) or snooker table, the specific structural, mechanical and/or arrangements and methods described herein may be employed in any of a variety of devices, structures and/or surfaces for playing games and/or sports, such as a ping-pong table, a foosball table, a card table, a skee ball or pin ball machine, table shuffle board or the like.

As a result of the method of producing/manufacturing the composite sheet 14, as described in detail below, the composite sheet 14 is preferably generally less brittle than slate and is not susceptible to warping like wood. Specifically, the density of the composite sheet 14 is substantially less than slate, resulting in a total weight of the composite sheet 14 and, thus, the playing surface 10 being substantially lighter than slate. Additionally, the physical properties of the composite sheet 14 produce the playing surface 10 that is preferably flexible enough to be less susceptible to breakage and/or cracking. Further, the composite sheet 14 is ideally suited to be built into the gaming table 12, 12' as one single piece at a factory or place of manufacture, rather than to be installed independently in the gaming table 12, 12' at a customer's location. However, one single piece of the composite sheet 14, generally the size and shape of the top surface of the gaming table 12, 12', is capable of being installed independently in/on the gaming table 12, 12' at a customer's location, for example, if so desired.

Figure 4:
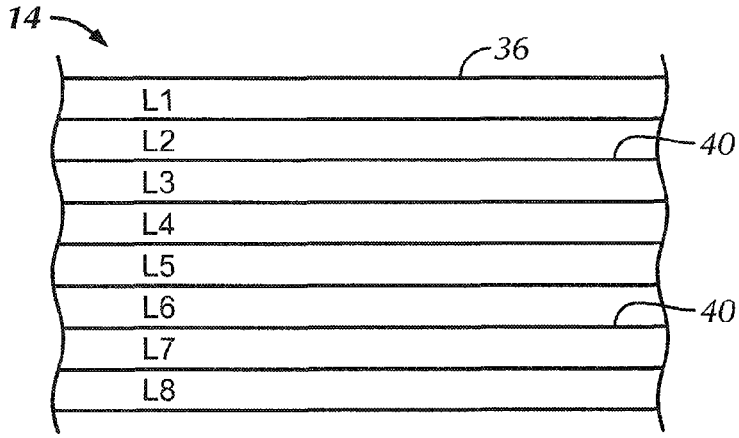
FIG. 4 is a magnified side elevation view of a portion of a finalized, solid composite material, produced by the method shown in FIGS. 2 and 3, in accordance with the preferred embodiments of the present invention.

Referring to FIG. 4, in the preferred embodiment, the final composite material 14 used in a gaming table 12, 12' is formed in a layered sequence, preferably comprising two or more layers, such as eight layers L1-L8. Specifically, it is preferred that the composite sheet 14 is a mixture of concrete or cement, as well as at least one fiber component or composite. The at least one fiber component or composite may be wood pulp, fiberglass and/or ground or crushed rock, for example. The concrete may include fly ash, slag cement, gravel, limestone, granite, sand, water and/or chemical add mixtures, such as calcium, silicon, aluminum and/or sulfate. The composite sheet 14 may also include a bonding and/or hardening agent, such as mortar, plaster and/or adhesive, wood pulp and/or ground or crushed rocks, including slate. The composite sheet 14 may include more or fewer ingredients than those identified above.

Figure 2:
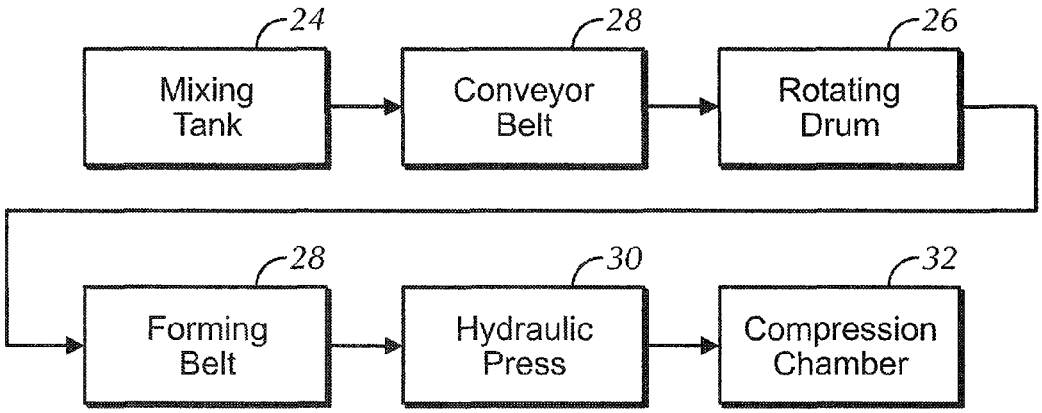
FIG. 2 is a block diagram depicting a method of manufacturing a playing surface in accordance with the preferred embodiments of the present invention.
Figure 3:
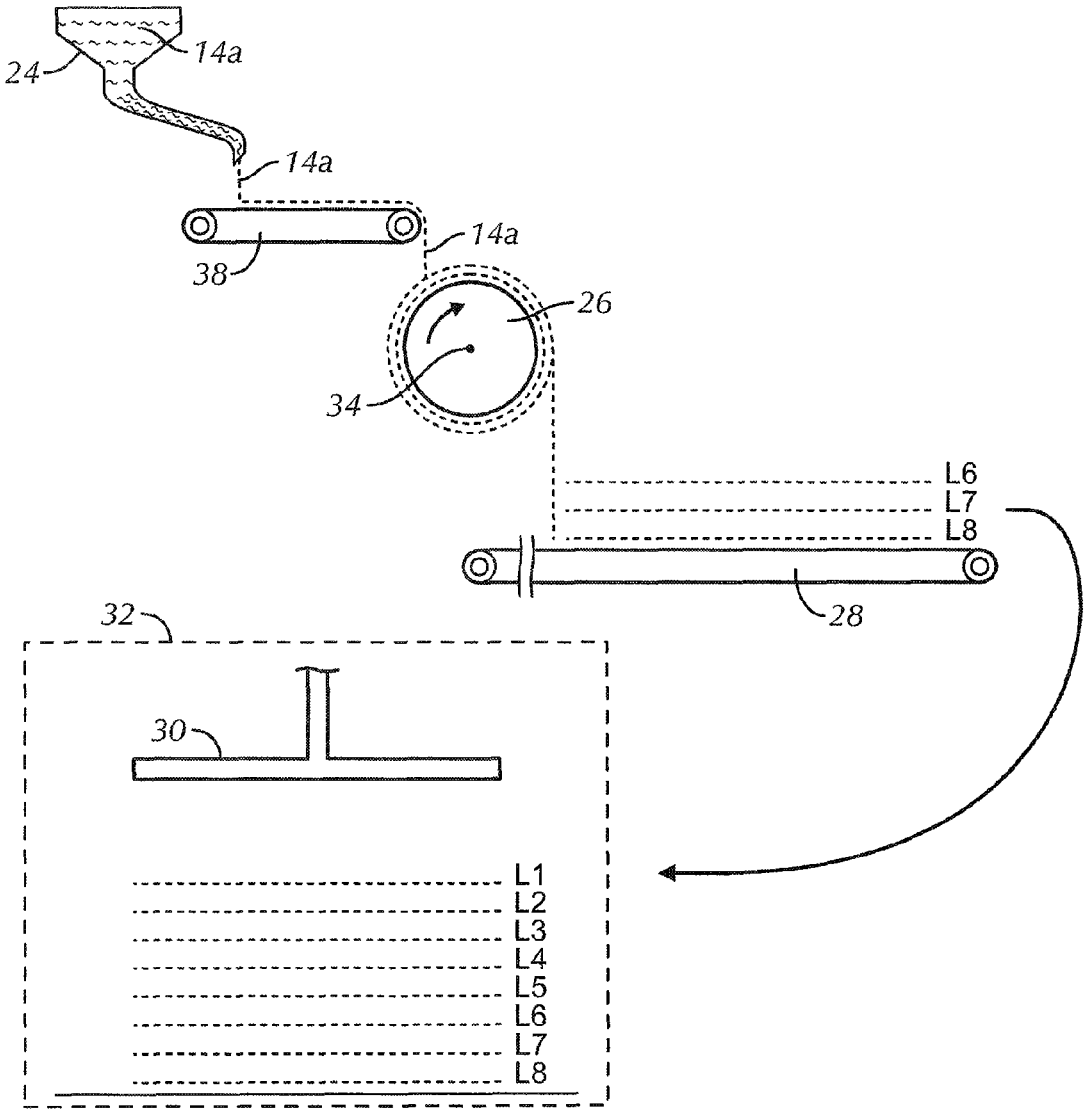
FIG. 3 is a more detailed schematic diagram depicting one version of the method of manufacturing shown in FIG. 2.

Referring to FIGS. 2 and 3, a method of producing the composite sheet 14 suitable for use as a playing surface 10 on a gaming table 12, 12' preferably includes loading and/or placing certain or all of the above-identified ingredients into a container, such as a mixing tank 24. It is preferred that the combined ingredients of the composite sheet 14 are then stirred and/or mixed for a predetermined amount of time, for example, until the ingredients form a desired consistency of a semi-solid, semi-liquid and/or paste form. In a preferred embodiment, the combined ingredients are stirred or mixed for a minimum of ten (10) minutes at above thirty two degrees Fahrenheit (32° F.). Once the semi-solid composite mixture or material 14*a* has achieved the desired consistency and/or viscosity, the semi-solid composite mixture 14*a* is then preferably deposited, such as by the force of gravity, onto a conveyor belt 38 or other suitable support surface. Next, the semi-solid composite mixture 14*a* is then preferably deposited, such as by the force of gravity, onto a rotating drum 26. In the preferred embodiment, the rotating drum 26 is generally circular in cross-section and has a circumference of approximately eight feet (8 ft.). However, the size and shape of the rotating drum 26 may be modified depending on the desired characteristics of the finalized composite material 14.

In operation, as the rotating drum 26 continues to rotate about a preferably fixed point 34 (FIG. 4) in either a clockwise or counterclockwise direction, and the semi-solid mixture

14*a* is deposited onto the drum 26, preferably several layers of the semi-solid mixture 14*a* form around the outer circumference of the drum 26. However, as few as two layers may form at only a portion of the rotating drum 26. When the desired number of layers of the semi-solid mixture 14*a* have accumulated around/on the rotating drum 26, at least a portion of each of the layers is cut or sliced at a predetermined point or spot, preferably causing the layers to fall due to gravity on a conveyor or forming belt 28 that is preferably slightly larger in area than the desired final size of the playing surface 10 of the gaming table 12, 12' (i.e., eight feet in length and four feet in width).

In the preferred embodiment, more than one semi-solid mixture 14*a* is laid on top of the forming belt 28, which may reciprocate in either a circular or linear back-and-forth fashion beneath the rotating drum 26. Specifically, a generally flat piece of material 40 (see FIG. 4), such as a polymeric material or wood, may be used to separate each combined semi-solid mixture 14*a*. Next, it is preferred that the one semi-solid mixture 14*a* or multiple semi-solid mixtures 14*a* are compressed using a compression device, such as a hydraulic press 30. Specifically, the two or more layers of semi-solid mixture 14*a* are moved away from or off of the forming belt 28 and beneath and/or into the hydraulic press 30. In the preferred embodiment, the total time that the semi-solid mixture 14*a* is compressed for approximately eight to ten hours, but such time can be modified depending upon the desired final characteristics of the composite sheet 14. For example, the total compression time may be for a predetermined amount of only several minutes in length.

In the preferred embodiment, the semi-solid composite mixture 14*a* passes through or is subjected to at least two separate and distinct compression cycles to reach the desired solid state. For example, it is preferred that the semi-solid composite mixture 14*a* is subjected to a compression cycle using only a predetermined amount of pressure. A preferred compression level is preferably approximately twenty five mega pascals (25 MPa) or three thousand six hundred thirty pounds per square inch (3630 lbs/in$^2$), but the semi-solid composite mixture 14*a* and method of producing same is not limited to this compression level, as the compression level preferably falls within a range of approximately twenty to thirty mega pascals (20-30 MPa). Preferably, the semi-solid composite mixture 14*a* is then subjected to a second compression cycle subjected to preferably a predetermined amount of heat and pressure. Again, a preferred compression level for the second compression cycle is preferably approximately twenty five mega pascals (25 MPa) or three thousand six hundred thirty pounds per square inch (3630 lbs/in$^2$), but the semi-solid composite mixture 14*a* and method of producing same is not limited to this compression level, as the compression level may fall within a range of approximately twenty to thirty mega pascals (20-30 MPa).

As the layers of the semi-solid composite mixture 14*a* are subjected to one or more compression cycles, a substantial amount of moisture is preferably forced from the semi-solid composite mixture 14*a* and drained therefrom, resulting in an increasingly denser and harder combination of materials. The density of the semi-solid composite mixture 14*a* following completion of the above-identified method is preferably approximately one and forty five hundredths grams per cubic centimeter (1.45 g/cm$^3$) or 0.0505 pounds per cubic inch (lbs/in$^3$), but the semi-solid composite mixture 14*a* and method of producing same is not limited to this density, as the density may fall within a range of approximately one to two grams per cubic centimeter (1-2 g/cm$^3$). The total compression time may vary from less than a minute to several hours, but the present invention is not so limited.

Further, the compression cycle(s) may occur in a compression chamber 32, in which the composite material 14*a* or composite sheet 14 is preferably kept for approximately twenty-two hours. Heat and/or pressure are preferably applied to the composite material 14*a* or composite sheet 14 in the compression chamber 32. Although reference is made to a compression chamber 32 that is part of and/or surrounds the hydraulic press 30, the method of the present invention is not so limited. Once the compression cycle(s) is complete, the compressed composite material 14*a* must dry in order to fully transform the semi-solid mixture 14*a* into the desired solid composite sheet 14 having the desired hardness level. Drying of the composite sheet 14 may be accomplished by air drying, but is preferably dried in a kiln that is also an air compression chamber.

Applicant performed a Flexural strength test on a preferred embodiment of the finalized, solid composite sheet 14. The Flexural strength test involved a seven and one half foot (7.5 ft) span of the preferred solid composite sheet 14 supported at three spaced-apart points or locations. A force or pressure was applied to the finalized, solid composite sheet 14 in the middle of the three spaced-apart support points. The solid composite sheet 14 did not break until a force or pressure of at least four thousand pounds-per-square-inch (4,000 psi) was applied. In addition, Applicant preformed an impact test on the preferred sample solid composite sheet 14. The impact test was conducted by dropping a standard or conventional billiard ball onto the composite sheet 14 various heights. During the impact test, the solid composite sheet 14 was covered on the impact side with nineteen ounce (19 oz) billiard cloth. The results of the test, wherein "height" indicates the height at which the billiard ball was dropped and "depth of impact" indicates the deepest part of the impression of the billiard ball, are as follows:

| Height (ft) | Depth of Indent (mm) |
|---|---|
| 1 | 0.070 |
| 2 | 0.150 |
| 3 | 0.140 |
| 4 | 0.160 |
| 5 | 0.300 |
| 6 | 0.270 |
| 7 | 0.350 |
| 8 | 0.360 |
| 9 | 0.360 |
| 10 | 0.420 |

The sample composite sheet 14 of the present application is not limited to constructions using materials having a depth of indent results that are the same as disclosed above, but the results are used to show a preferred example of how a composite sheet 14 may perform under such tests. Generally, it is preferred that the composite sheet 14 have hardness properties similar to slate or other materials that may be utilized for a conventional surface or bed of a pool table. For example, a preferred embodiment of the composite sheet 14 has a hardness of approximately 5.5 on the Mohs hardness scale, approximately 81 on the Rockwell A hardness scale, approximately 60 on the Rockwell C hardness scale, approximately 70 on the Rockwell D hardness scale, approximately 705 on the Knoop hardness test, and/or approximately 697 on the Vickers hardness test. However, the composite sheet 14 is not limited to any of the above-identified hardness levels, as the composite sheet 14 may have a higher or lower value on any one of the above-identified scales depending on the desired characteristics of the playing surface 10.

The finalized, solid composite sheet 14 may be produced at various levels of density, depending upon the specific formulation used to create the composite sheet 14, the number of layers desired of the composite sheet 14, and/or the thickness of each non-compressed layer and the compression force applied to the layers of the composite sheet 14. The preferred compression level is preferably approximately twenty five mega pascals (25 MPa) or three thousand six hundred thirty pounds per square inch (3630 lbs/in$^2$), but the composite sheet 14 and method of producing same is not limited to this compression level, as the compression level may fall within a range of approximately twenty to thirty mega pascals (20-30 MPa). Further, the density of the composite sheet 14 following completion of the above-identified method is preferably approximately one and forty five hundredths grams per cubic centimeter (1.45 g/cm$^3$) or 0.0505 pounds per cubic inch (lbs/in$^3$), but the composite material 14 and method of producing same is not limited to this density, as the density may fall within a range of approximately one to two grams per cubic centimeter (1-2 g/cm$^3$).

Once the composite sheet 14 has properly dried and/or hardened, it is preferred that the composite sheet 14 be subjected to several additional processes to improve certain characteristics of the composite material 14. In the preferred embodiment, one or more sides of the composite sheet 14 is preferably sanded by hand or by any type of sanding machine. Depending upon the type of gaming table 12, 12', two or more separate and/or independent sanding steps may be required. In the preferred embodiment, at least an upper or top surface 36 of the composite sheet 14 is sanded two separate times.

Further, in the preferred embodiment, the dried and sanded composite sheet 14 must be cut or trimmed to the desired overall size. For example, for a billiard table, angled or arcuate cuts or indentations 21 are preferably made proximate a perimeter of the composite sheet 14, which will serve as the preferably six pockets 18, 18' for the table 12, 12'. Furthermore, one or a pattern of through holes or indentations (none shown) may be formed in at least a portion of the composite sheet 14 to allow the composite sheet 14 to be properly mounted into the gaming table 12, 12'. For example, one or more holes may be formed through the composite sheet 14 preferably proximate an outer edge thereof, so that fastening members (not shown) may pass therethrough to engage at least a portion of the gaming table 12, 12'. The through holes may be formed at a sufficiently outer portion of the composite sheet 14, such that they may be at least partially covered by the rails 22 of the gaming table 12 so as not to affect the smoothness of the exposed playing surface 10. Alternatively and/or additionally, one or more indentations may be formed in a bottom surface of the composite sheet 14 to receive at least a portion of a fastener or adhesive (none shown) therein to firmly secure the composite sheet 14 to the gaming table 12, 12' and to preserve the smooth, flat and/or planar top surface of the composite sheet 14. Once the finalized, solid composite sheet 14 is properly mounted into/onto the gaming table 12, cloth or fabric material, such as felt, may be fixedly or removably attached to at least a portion of the top surface 36 thereof to form the finalized playing surface 10.

The finalized, solid composite sheet 14 manufactured in accordance with the above-described method preferably has a greater density than wood or wood composite materials, but is less dense than slate. Further, the finalized, solid composite sheet 14 is preferably less susceptible to undesirable deformation and/or warping than wood or wood composite materials and is easier to form, produce and/or generally work with. Unlike wood playing surfaces, the finalized, solid composite sheet 14 is impervious to moisture and allows for easy replacement of the cloth or fabric material. Unlike slate playing surface, the finalized, solid composite sheet 14 may be formed as a seamless, one piece playing surface. In addition, the finalized, solid composite sheet 14 preferably can be manufactured in thinner dimensions than slate because it is preferably less brittle than slate and can be manufactured and installed as a single, unitary and integral piece.

It is understood by those skilled in the art that the finalized, solid composite sheet 14 may be formed in a variety of physical configurations, shapes and/or sizes to conform to the desired dimensions of the playing surface 10. Further, the method of producing the composite sheet 14 is not limited to the exact number and/or order of steps described in detail above, but may include more or fewer steps in a modified order of operations, if so depending on the desired final characteristics of the finalized, solid composite sheet 14. Furthermore, the finalized, solid composite sheet 14 may also be connected and/or combined with other materials to improve certain characteristics of the playing surface 10.

For example, although the finalized, solid composite sheet 14 may be the only piece that serves as the entire playing surface 10, the finalized, solid composite sheet 14 may include strips of additional material such as wood or rigid foam adhered to the underside or bottom surface thereof. This additional material preferably serves as a frame and may alternatively be a single and/or solid, unitary piece of additional material covering a substantial or the entire underside of the composite sheet 14. Alternatively, the additional material may be strips added to the underside of the composite sheet 14. In addition, the finalized, solid composite sheet 14 may be cut into predetermined smaller pieces or segments, such that the playing surface 10 can fit into a smaller packaging for transportation and/or storage purposes. For example, the finalized, solid composite sheet 14 may be manufactured and sold as a stand-alone item for use as a playing surface 10 or the composite sheet 14 may be sold and manufactured as part of a pre-installed gaming table 12, 12'.

It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the present disclosure and/or the appended claims.

I claim:

1. A billiard table comprising:

a playing surface comprised of a composite sheet including concrete and at least one fiber component, the composite sheet having a density of one to two grams per cubic centimeter (1-2 g/cm$^3$), a cloth material covering at least a portion of a top surface of the composite sheet;

a body supporting the playing surface in an assembled configuration;

at least one leg depending downwardly from the body;

at least one pocket being sized and shaped for receiving a gaming ball maneuvered on the playing surface; and at least one rail above the playing surface, the at least one rail extending over at least a portion of the playing surface.

2. The playing surface according to claim 1 wherein the composite sheet further includes at least one hardening agent.

3. The billiard table according to claim 2 wherein the composite sheet further includes wood pulp and ground rocks.

* * * * *